US005474286A

United States Patent [19]

Reist

[11] Patent Number: 5,474,286

[45] **Date of Patent: * Dec. 12, 1995**

[54] PROCESS AND DEVICE FOR OPENING FOLDED PRINTED PRODUCTS

[75] Inventor: Walter Reist, Hinwil, Switzerland

[73] Assignee: Ferag AG, Switzerland

[ * ] Notice: The portion of the term of this patent subsequent to Oct. 11, 2011, has been disclaimed.

[21] Appl. No.: 319,942

[22] Filed: Oct. 7, 1994

Related U.S. Application Data

[63] Continuation of Ser. No. 44,782, Apr. 5, 1993, Pat. No. 5,354,043.

[30] Foreign Application Priority Data

Jun. 4, 1992 [CH] Switzerland ..... 1116/92

[51] Int. Cl.[6] ..... B65H 39/02

[52] U.S. Cl. ..... 270/54

[58] Field of Search ..... 270/54, 55; 271/175, 271/200, 204, 246, 247, 277

[56] References Cited

U.S. PATENT DOCUMENTS

| | | | |
|---|---|---|---|
| 2,817,513 | 12/1957 | Bell et al. . | |
| 3,527,455 | 9/1970 | Reist . | |
| 3,580,562 | 5/1971 | Reist | 270/54 |
| 4,398,710 | 8/1983 | Hansch . | |
| 4,489,930 | 12/1984 | Meier | 270/55 |
| 4,684,116 | 8/1987 | Hänsch | 270/54 |
| 4,684,117 | 8/1987 | Honegger et al. | 270/54 |
| 5,005,815 | 4/1991 | Auksi | 270/54 X |
| 5,248,135 | 9/1993 | Leu | 270/55 |
| 5,277,413 | 1/1994 | Boss | 270/54 |
| 5,292,111 | 3/1994 | Hansch | 270/54 |
| 5,301,937 | 4/1994 | Hansch | 271/204 |

FOREIGN PATENT DOCUMENTS

| | | |
|---|---|---|
| 1024530 | 11/1954 | Germany . |
| 667859A5 | 11/1988 | Switzerland . |
| 1095733 | 12/1967 | United Kingdom . |

*Primary Examiner*—Edward K. Look
*Assistant Examiner*—John E. Ryznic
*Attorney, Agent, or Firm*—Willian Brinks Hofer Gilson & Lione

[57] ABSTRACT

Printed products are transported in the direction of conveyance suspended, held by their fold, from transporting clamps of a conveying device. The end area of the printed products rests on a supporting mechanism and the uppermost product part protrudes with its marginal section over the bottommost product part. To the two product parts there is in each case assigned a gripper of the opening device. The grippers are disposed on a revolutionally driven drawing member. The clamping tongue of the first gripper grips underneath the marginal section and, upon running up against an opening crank, lifts the product part from the bottommost product part. The second gripper grasps the lifted-off product part in the marginal section and, when the clamping tongue is lowered into the closed position, the latter clamps the product part between itself and the clamping jaw of the first gripper, by the end edge. The first gripper revolves at a greater velocity than the second gripper. Thus, the two product parts are lifted apart in the direction of conveyance.

1 Claim, 12 Drawing Sheets

PROCESS AND DEVICE FOR OPENING FOLDED PRINTED PRODUCTS

This application is a continuation application of application Ser. No. 08/044,782, filed Apr. 5, 1993 entitled "Process And Device For Opening Folded Print Products", now U.S. Pat. No. 5,354,043 issued Oct. 11, 1994.

BACKGROUND OF THE INVENTION

The present invention relates to a process and a device for opening folded printed products, in particular newspapers, magazines and parts thereof.

It is known, for example from U.S. Pat. No. 4,489,930 and the corresponding EP-A-0 095 603, to hold eccentrically folded printed products, where the fold runs transversely to the direction of conveyance, with transporting clamps and to transport them suspended obliquely towards the rear. In this type of arrangement, an opening device is disposed beneath the conveying device. The opening device has a continuous belt which is driven at the transport velocity of the conveying device, on which belt there are disposed grippers, at a distance from the transporting clamps. The active strand of the belt runs parallel to the direction of conveyance and a supporting mechanism is connected upstream from the belt in order to support the printed products in their trailing end area lying opposite the fold. Adjoining the belt (viewed in the direction of conveyance) is a small conveyor belt, which revolves at a higher speed in relation to the transport velocity of the conveying device. The uppermost product part has a marginal section, in the end area, which protrudes over the shorter, bottommost product part. This marginal section is grasped, in each case, by a gripper of the opening device and clamped in place between the gripper itself and the belt. The bottommost, shorter product part is moved, bulging out as it does so, by the faster-running, small conveyor belt away from the held product part in the direction of conveyance and the print product thereby opened. A collecting bar of a collecting device runs into the opened print product, in each case, between the product parts which have been lifted apart. Following the release of the printed products by the transporting clamps, the printed products fall astride onto the collecting bars.

Using this known process and using this known device, only printed products which are transported with a trailing end area and an uppermost marginal section can be transported. Reliable opening of the printed products is only possible if the paper has a low natural stiffness, the bottommost product part has a certain weight and further the leaves do not stick together.

U.S. Pat. No. 4,684,117 and the corresponding EP-A-O 208 081 further disclose a process and a device for opening eccentrically folded printed products having a trailing fold (viewed in the direction of conveyance) and a leading marginal area lying opposite the fold. The printed products are held, at the fold, by individually controllable grippers of a conveying device and transported in a direction of conveyance running obliquely from top to bottom. In this arrangement, an opening device is provided beneath the conveying device. The opening device includes grippers disposed on a revolutionally or revolvingly driven drawing member. Laterally, next to the drawing member, there is provided a fixed supporting plate and, connected upstream from this, a revolutionally or revolvingly driven, continuous supporting belt to support the printed products in the leading end area. If the printed products are transported such that the product part having the marginal section protruding over the shorter product part is bottommost, the corresponding gripper is transferred into the open position and the particular transporting 3 clamp of the conveying device is opened for a short time so that the marginal section slides into the mouth of the gripper. The bottommost product part held by the marginal section is now, when the drawing member is deflected around a deflection pulley, moved away from the other, non-held product part in a direction transverse to the direction of conveyance. Between the product parts which are thus partially lifted apart, there is introduced a collecting conveyor on which the printed product falls astride whenever the transporting clamp is opened.

If, on the other hand, the printed products are transported with the product part having the marginal section uppermost, then when the respective gripper is opened, the marginal section gripped underneath by a clamping tongue of the gripper is raised up and the respective transporting clamp is opened for a short time. In this manner, the bottommost shorter product part slides into the working area of the gripper. After the gripper is closed, the shorter product part held thereby is in turn deflected, upon the deflection of the gripper, around the deflection pulley in a direction transverse to the direction of conveyance. In order to open the printed product, the shorter product part is moved away from the non-held, uppermost product part. This known process and the corresponding device, only contemplate the opening of printed products which are transported with a trailing fold and a leading end area and a direction of conveyance running obliquely from top to bottom. Furthermore, reliable opening of the printed products is not assured if the products have a very low natural stiffness and stick together.

It is therefore an object of the present invention to refine the process of the generic type and provide a corresponding device, wherein opening of printed products is reliably guaranteed.

It is a further object of the present invention to provide a process for opening printed products and a corresponding device wherein opening is independent from the position and nature of the printed products.

SUMMARY OF THE INVENTION

To achieve these and other objects in the arrangement of the present invention, an arrangement is provided wherein the product parts of the printed product, bear against each other, are supported in their end area and are lifted apart transversely to the direction of conveyance. This is effected in a small area, so that the product parts are grasped without difficulty by corresponding grippers of an opening device. The grippers are driven at different velocities. As a result, the end edges of the product parts are now moved away from each other in the direction of conveyance. As this takes place, the product parts are held by the grippers. Thus, a forcible mutual separation of the product parts is guaranteed, even if the product parts stick together. Since the grippers are moved in the direction of conveyance, a considerable amount of time is available for opening. Furthermore, at least the one product part is bulged or brought into a position which is more stretched in relation to the other product part, so that the product parts are lifted apart not only in the end area, but right up to the transporting clamp.

It will be appreciated that this lifting apart does not necessarily, in all cases, have to be effected over the entire width of the printed products. Often it is sufficient to lift the printed products apart at a lateral edge adjoining the fold.

Preferably, it is the uppermost product part in each case which is raised. This raising can be effected when the gripper assigned to the bottommost product part is opened, by gripping underneath the upper product part with the moved clamping tongue. The opening device can consequently be of the simple configuration. If the product part having the marginal section is on top, then the gripping underneath of the marginal section can be effected without difficulty, in particular if the end edge of the print product is brought to bear against a stop on the gripper. The position of the end section is in this case precisely fixed in relation to the clamping tongue.

In order to ensure the gripping underneath of the uppermost product part if the bottommost product part has the protruding marginal section, the bottommost product part is bulged in the end area towards the uppermost product part. In this manner the uppermost product part, as a result of its natural stiffness, lifts away from the bottommost product part. Since this lifting only needs to be effected along a small section of the end edge of the product part, it is even guaranteed in printed products which have a low natural stiffness. The bulging of the bottommost product part of printed products which are held at their fold and supported in the end area in such a way that they are bent can be easily effected by the marginal section being bent downwards on one side and being pushed, with its end edge, in the direction of the end edge of the uppermost product part. It is possible for the uppermost product part now to be grasped directly by the corresponding gripper, without the former being further raised by means of the clamping tongue of the gripper assigned to the bottommost product part.

Using the process according to the invention and the corresponding device, printed products having a leading or a trailing end area and an uppermost or bottommost marginal section can be reliably opened.

BRIEF DESCRIPTION OF THE DRAWINGS

The present invention will now be described in greater detail with reference to the drawings which are in purely diagrammatic representation.

DETAILED DESCRIPTION OF THE PRESENTLY PREFERRED EMBODIMENTS

Figure 1:
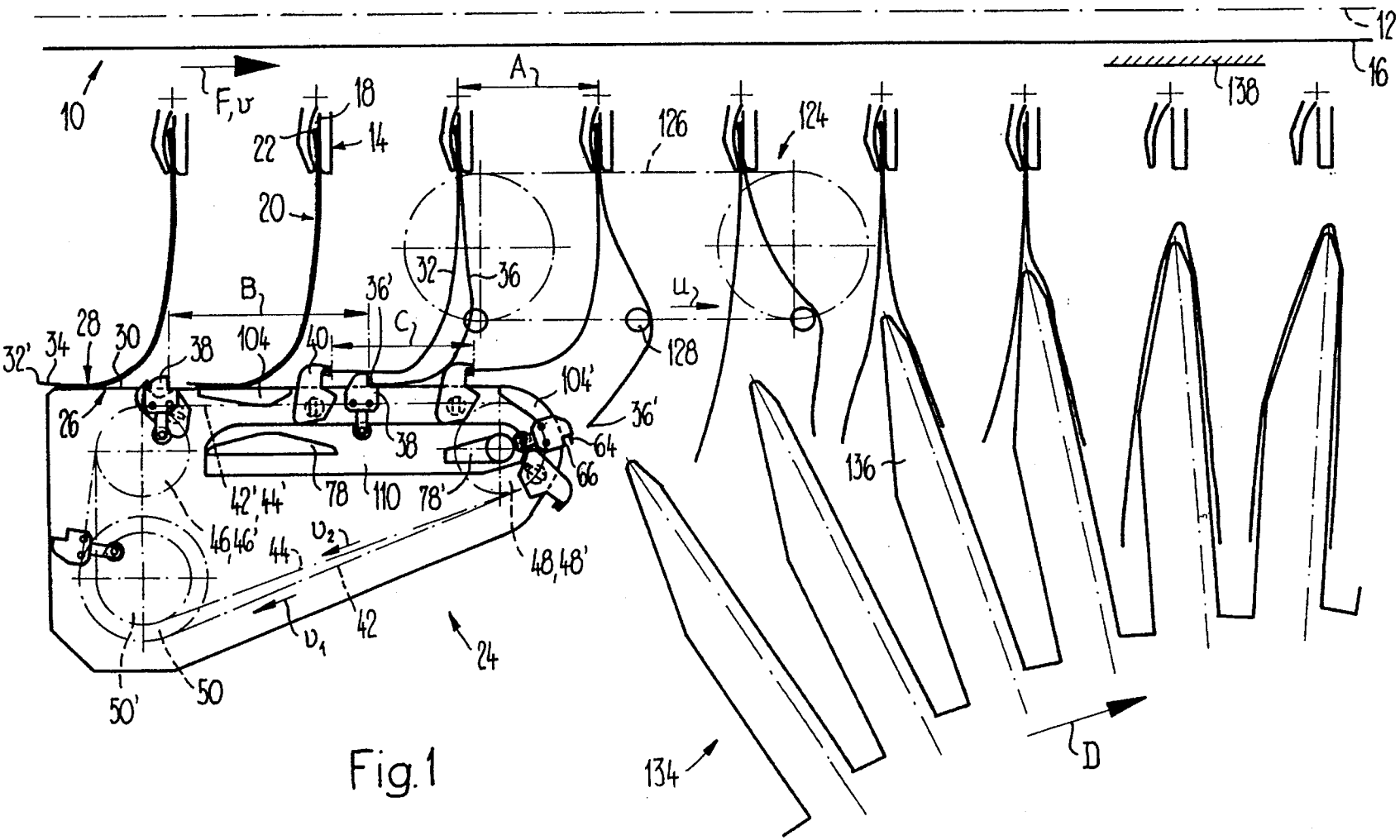
FIGS. 1 and 2 show a view of an embodiment of the device according to the invention at two different instants separated by half a work cycle.
Figure 2:
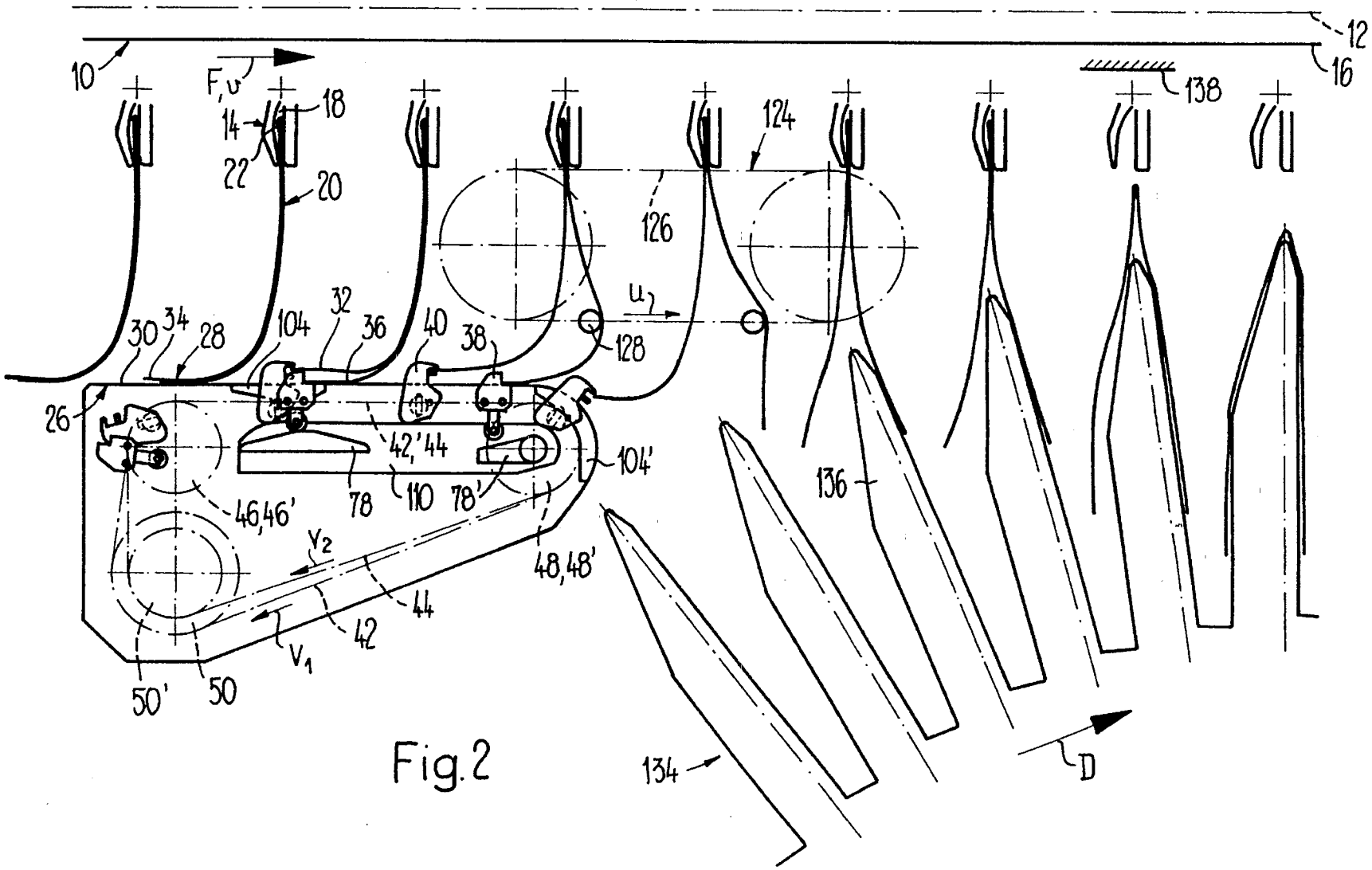
Figure 3:
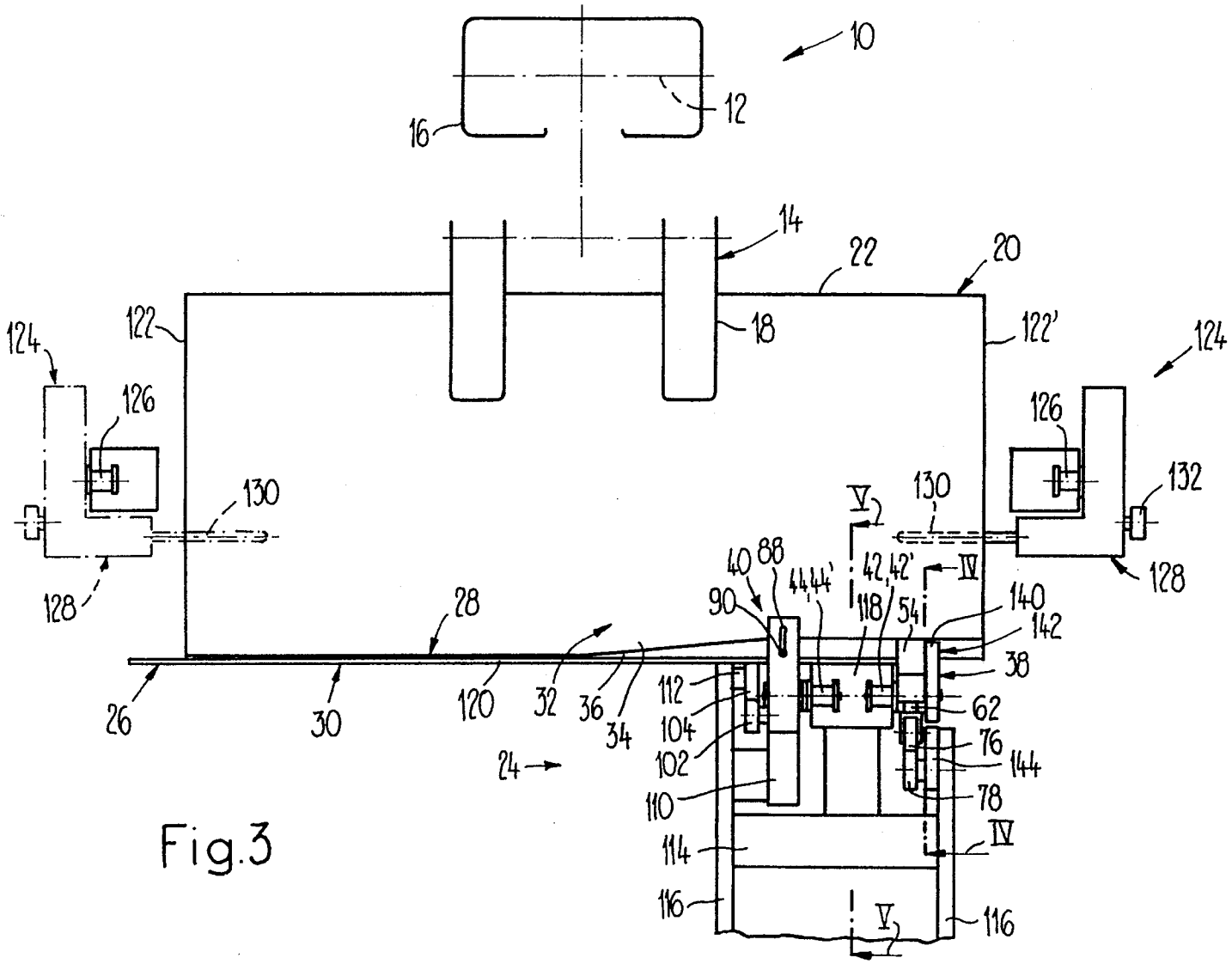
FIG. 3 shows the device according to FIGS. 1 and 2 in side view.
Figure 5:
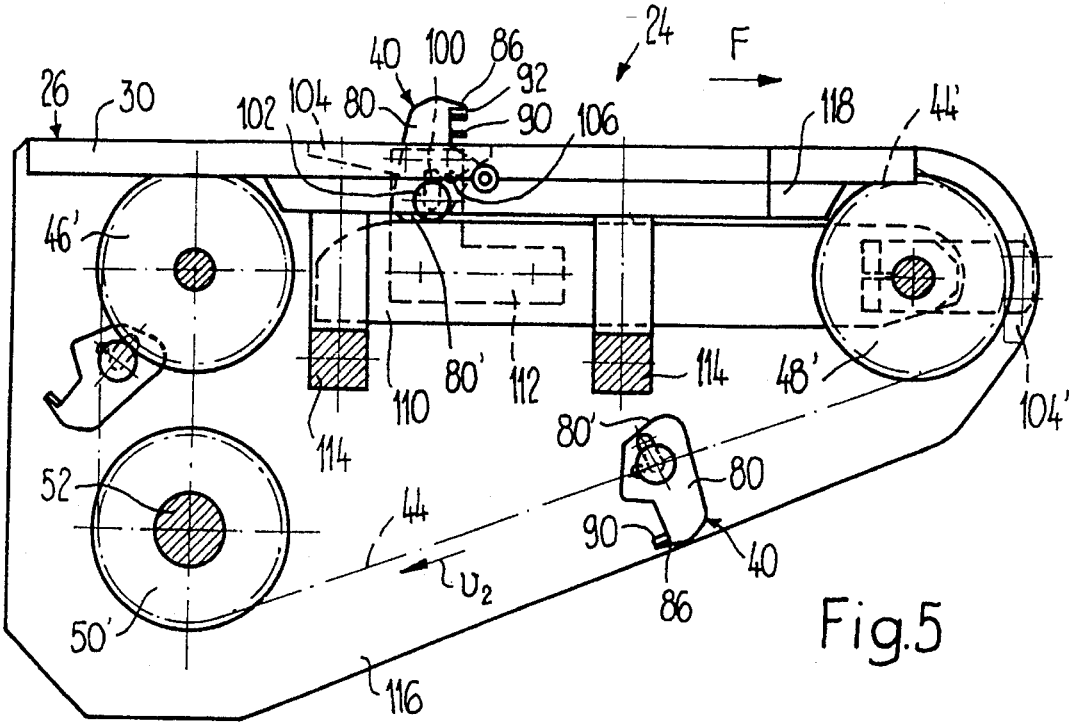
FIGS. 4 and 5 each show a part of the opening device, assumed to be transparent, in a section along the line IV—IV and of line V—V of FIG. 3.
Figure 4:
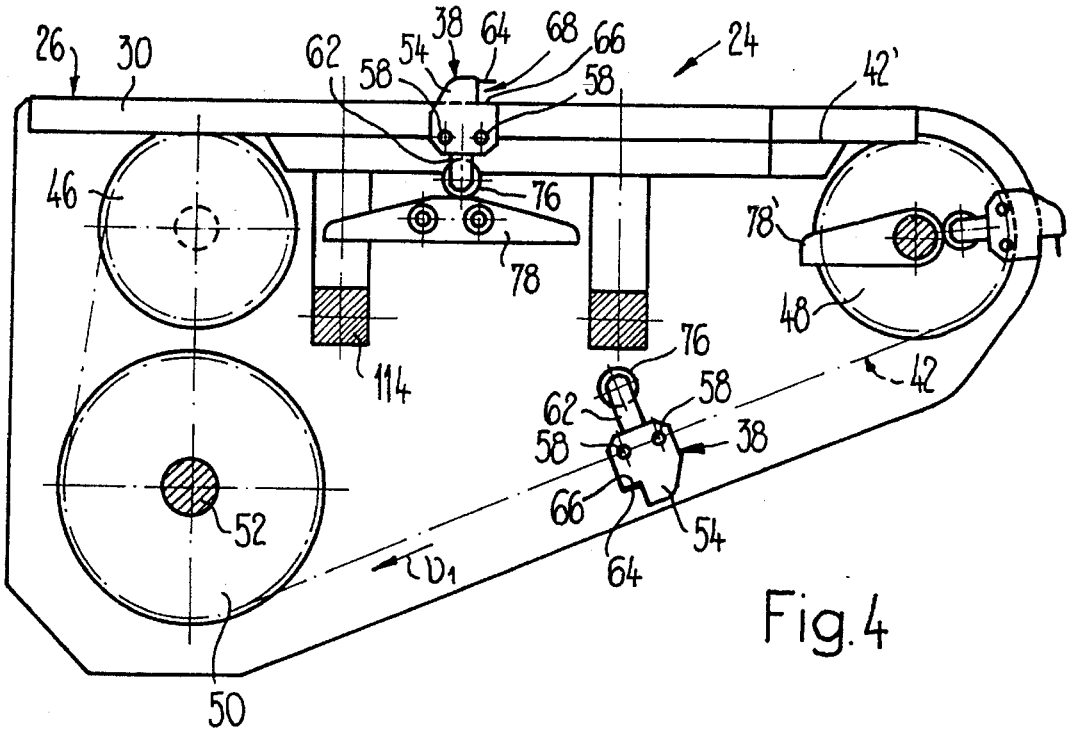

Referring specifically to FIGS. 1–3, the device comprises a conveying device 10 of a generally known type, having transporting clamps 14 disposed at a fixed distance A one behind the other on a conveyor chain 12 indicated by a dash-dotted line. The conveyor chain 12 is guided in a C-shaped, downwardly open channel 16 which extends in the horizontal direction. The transporting clamps 14, which are driven in continuous revolving movement in the direction of conveyance F, at a transport velocity v, include a clamping mouth 18. The clamping mouth 18 is directed downwards in a vertical direction, such that the transporting clamps 14 hold a folded printed product 20, preferably a multi-leaved newspaper, magazine or parts thereof, at the fold 22 running at right-angles to the direction of conveyance.

An opening device 24 is disposed beneath the conveying device 10 which has a supporting element 26. The supporting element 26 runs parallel to the direction of conveyance F. The printed products 20 bear flatly the supporting element 26 with their end area 28 facing away from the fold 22. As is clearly evident from FIGS. 1 and 2, the printed products 20 suspended freely from the transporting clamps 14 are bent rearwards as they run up against the supporting element 26, which is formed in the illustrated embodiment by a fixed supporting mechanism 30.

The printed products 20 are folded eccentrically such that they have a longer product part 30 and a shorter product part 36. The longer product part 32 has, in the end area 28, a marginal section 34, which protrudes over the other shorter product part 36. In the case of the example shown in FIGS. 1–3, the printed products 20 are conveyed in such a way that the shorter product part 36 leads. Hence, in the area of the supporting mechanism 30, the longer product part 32 having the marginal section 34 is uppermost. Obviously, in the vertical direction, the opening device 24 is only at such distance from the conveying device 10 that the printed products 20 are able to bear against the supporting element 26 with their end area 28. In order to be able to handle printed products 20 of different formats, the opening device 24 is adjustable in the vertical direction.

The opening device 24 is now described in greater detail below, with reference to FIGS. 4–13. In FIGS. 1–3, the reference symbols are only stated where this is necessary to an understanding of these figures.

The opening device 24 includes first grippers 38 each assigned to the bottommost product part (in the illustrated embodiment, the shorter product part 36) and second grippers 40 each assigned to the topmost product part (in the illustrated embodiment, the longer product part 32). A plurality of first grippers 38 are disposed on a continuous first drawing member 42, preferably a chain, at a fixed distance B which is greater than the distance A between the transporting clamps 14 (FIG. 1). Likewise, a plurality of second grippers 40 are disposed on a second drawing member 44, likewise preferably a chain, at a fixed distance C which corresponds approximately to the distance A between the transporting clamps 14. The drawing members 42, 44 revolve in mutually parallel planes and the active strands run alongside each other and parallel to the direction of conveyance F. The drawing members 42,44 are each guided around three correspondingly coaxially mounted deflection pulleys 46, 46', 48, 48', 50, 50'. The deflection pulleys 46,48 and 46', 48' limit the active strands 42', 44' having, in the present case, the same diameter. On the other hand, the deflection pulley 50 around which the rear strand of the first drawing member 42 is guided has a larger diameter than the deflection pulley 50' around which the rear strand of the second drawing member 44 runs. The ratio of these diameters is equal to the ratio of the distance B to the distance C. Since the deflection pulleys 50, 50' are seated rotationally fixed on a common drive shaft 52 (FIGS. 4 and 5), the ratio of the revolutional velocity v1 of the first drawing member 42 and the first grippers 38 to the velocity v2 of the second drawing member 44 and the second grippers 40 is equal to the ratio between the distance B between the first grippers 38 and the distance C between the second grippers 40.

One of the deflection pulleys 50 or 50' or both deflection pulleys 50, 50' can be disposed adjustably on the drive shaft 52 in the direction of rotation. In this manner, the phase relationship between the first and second drawing members 42, 44 and the conveying device 10 can be set such that in each case at the desired location, in the starting area (viewed in the direction of conveyance F) of the active strands 42', 44' a first gripper 38 and a second gripper 40 are respectively located side by side, as clearly shown by FIG. 1.

Figure 9:
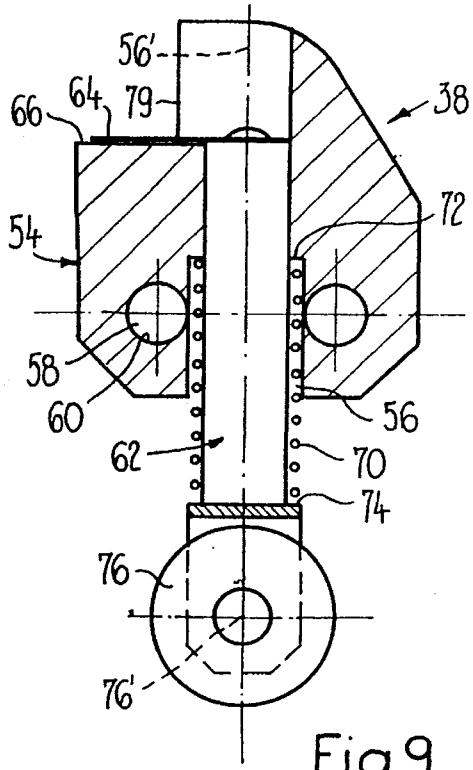
FIGS. 6 to 9 show, in top view or in sections along the corresponding lines of FIG. 6, a gripper of the opening device, which gripper is assigned to the bottommost product part.
Figure 8:
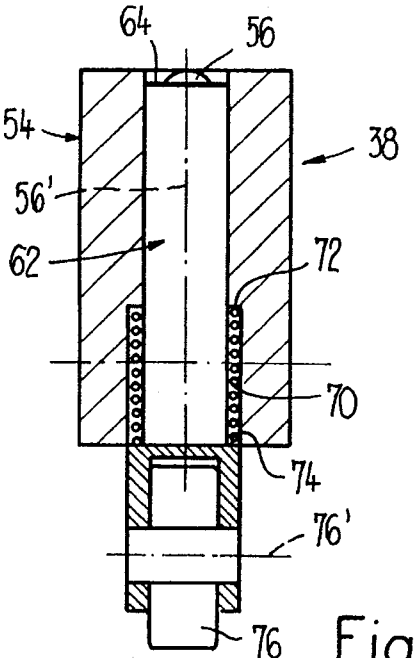
Figure 7:
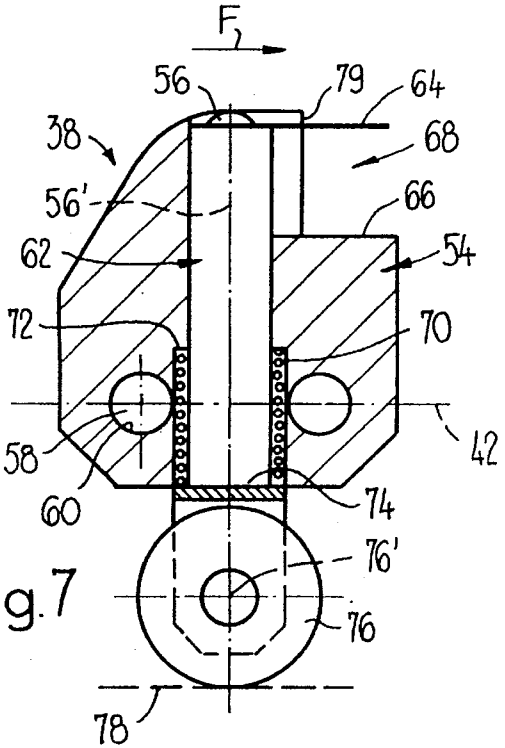
Figure 6:
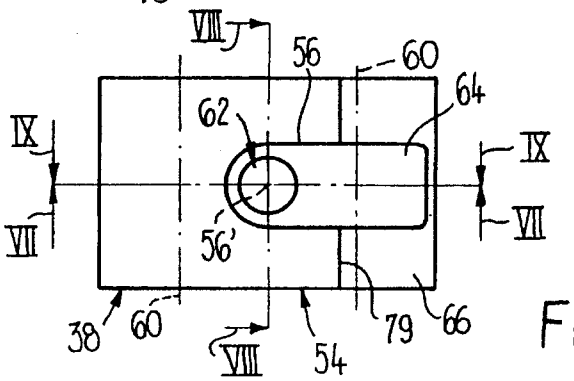

As can be observed, in particular, from FIGS. 6–9, the first gripper 38 includes a gripper body 54, through which runs an essentially cylindrical passage 56. The axis 56' of the passage 56 runs at right-angles to the first drawing member 42, indicated in FIG. 7 in dash-dot representation. The gripper body 54 is connected in a rotationally fixed manner to the first drawing member 42 by means of two fastening bolts 58, which pass through the gripper body 54 through corresponding bores 60. In the passage 56, a shank 62 is displaceably guided in the direction of the axis 56'. A leaf-like clamping tongue 64 is disposed at its upper end, projecting from the shank 62. The clamping tongue 64 interacts with a clamping jaw 66 formed onto the gripper body 54. The clamping tongue 64 and clamping jaw 66 form a gripper mouth 68, which, in the case of the opening device 24 according to FIGS. 1–4, is directed forwards (viewed in the direction of conveyance). As yet to be described below, the first grippers 38 may be disposed inversely on the drawing member 42, so that the gripper mouth 68 is directed counter to the direction of conveyance F. The clamping tongue 64 is pretensioned in the closing direction by means of a pressure spring 70. The pressure spring 70 embraces the shank 62 and is supported, at the top end, against a shoulder 72 of the gripper body 54 and, at the bottom end, against a counter-shoulder 74 on the shank 62. The closed position of the first gripper 38 is shown in FIG. 9. In its lower end area, a control roller 76 is mounted on the shank 62 so as to be freely rotatable about an axis 76' running at right-angles to the axis 56' and at right-angles to the direction of conveyance F. By means of an opening crank 78, the shank 62 can be raised counter to the force of the pressure spring 70 at right-angles to the direction of conveyance F, so that the clamping tongue 64 can be transferred into the open position shown in FIG. 7. A stop limiting the gripper mouth 68 is denoted by reference numeral 79.

The second gripper 40 is constructed similarly to the first gripper 38, as can be observed, in particular, from FIGS. 10–13. A gripper body 80 likewise includes an essentially cylindrical passage 82, the axis of which is denoted by 82'. In the passage 82, a shank 84 is likewise guided displaceably in the direction of the axis 82'. The upper end area of the gripper body 80 includes a fixed gripper jaw 86, which (viewed in the direction of conveyance F) protrudes in a nose-like fashion. Adjoining the gripper jaw 86, a guide slot 88 is recessed in the gripper body 80. The guide slot runs in the direction of the axis 82'. A clamping pin 90, which penetrates the shank 84 at right-angles to the axis 82', is guided in the guide slot 88. The clamping pin 90 interacts, as a movable gripper jaw, with the fixed gripper jaw 86, these forming a gripper mouth (denoted by reference numeral 92). The gripper mouth 92 in the case of the opening device 24 according to FIGS. 1–5, is directed forwards (viewed in the direction of conveyance F) in the area of the active conveying strand 44'. These second grippers 40 can also be disposed on the second drawing member 44 rotated by 180, so that the gripper mouth 92 is directed counter to the direction of conveyance F, as is described further below in connection with FIGS. 27 and 28.

Figure 13:
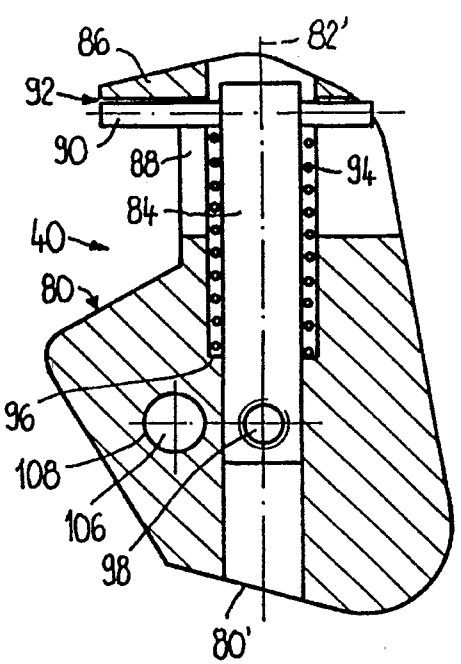
FIGS. 10 to 13 show, in top view or in sections along the corresponding lines of FIG. 10, a gripper of the opening device, which gripper is assigned to the uppermost product part.
Figure 12:
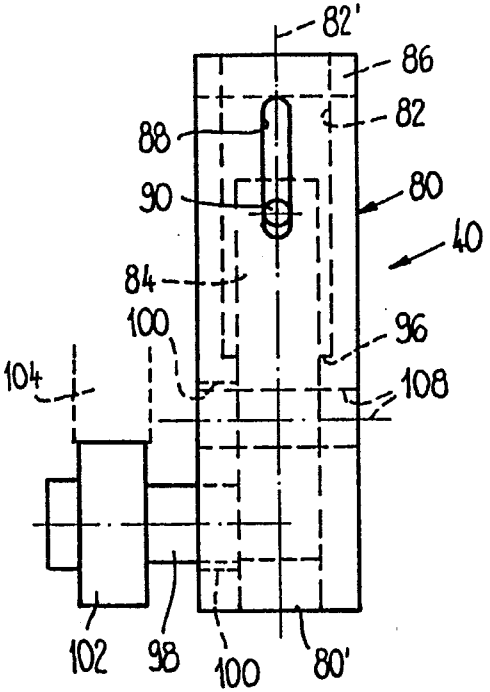
Figure 11:
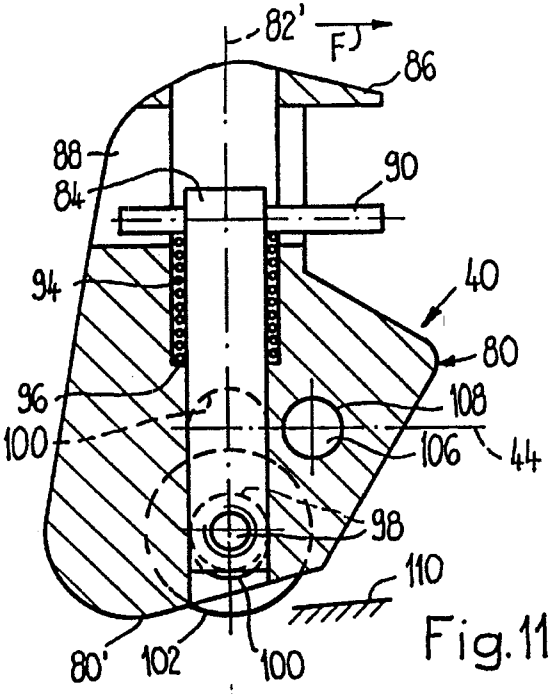
Figure 10:
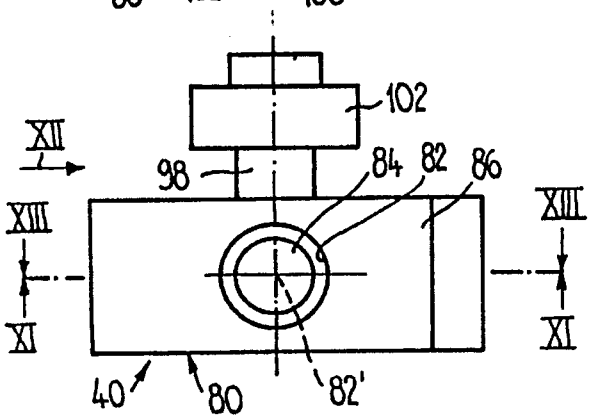

A closing spring 94, configured as a pressure spring, is supported by its upper end against the clamping pin 90. The closing spring 94 embraces the shank 84 and is supported at its bottom end against a gripper body shoulder 96. The closing spring 94 forces the clamping pin 90 in the closing direction towards the fixed gripper jaw 86. The closed position of the second gripper 40 is shown in FIG. 13.

In the lower end area, a bearing shaft 98 projects in the radial direction from the shank 84. The bearing shaft 98, penetrates a longhole-type opening 100 in the gripper body 80. Outside the gripper body 80, a control roller 102 is likewise mounted on the bearing shaft 98 so as to be freely rotatable. By means of a further opening crank (FIG. 12) (denoted by reference numeral 104) the clamping pin 90 can be transferred counter to the force of the closing spring 94 into the open position shown in FIG. 11.

The gripper body 80 is attached by means of a single fastening bolt 106 (see also FIG. 5) to the second drawing member 44. The fastening bolt 106 penetrates the gripper body 80 through a bore 108, the axis of which runs at right-angles to the axis 82' and at right-angles to the direction of conveyance F. The bore 108 is offset, in relation to the center of gravity of the second gripper 40, forwards in the direction of conveyance F. With this configuration the second gripper 40 which is pivotably disposed in the second drawing member 44 has the tendency, in the area of the active strand 44', to pivot backwards in the counter-clockwise direction. The gripper body 80 is therefore configured, in its lower end area 80', as a slide block, which interacts with a swivel crank 110 provided in the area of the active strand 44'.

The shape and position of the opening crank 78 interacting with the first gripper 38 and of the opening crank 104, acting upon the second gripper 40, and of the swivel crank 110 can be derived from FIGS. 1,2,4 and 5. The swivel crank 110 commences, viewed in the direction of conveyance F, after the deflection pulley 46' and extends into the area of the deflection pulley 48'. In the starting area of this swivel crank 110 and above it, there is provided the opening crank 104 for the second gripper 40. The opening crank 78 for the first gripper 38 is located adjacent to the opening crank 104.

At the end of the active strands 42',44', in the area of the deflection pulleys 48,48', further opening cranks 78',104' are provided in order to open the first or the second grippers 38,40, respectively, there and release those product parts 32,36 which are held by them.

The opening device 24 includes two bearing brackets 116, interconnected by crossbars 114. The opening cranks 78,78', 104',104' are attached to the bearing brackets 116 such that they are adjustable, where appropriate, using the shaft of the deflection pulleys 48,48' and the swivel crank 110. As can be observed from FIG. 3, supported against the crossbars 114 is a guide rail 118. The drawing members 42,44, configured as chains, are guided on the guide rail 118 in the area between the deflection pulleys 46,46' and 48,48'. From this guide rail 118 and to the left bearing bracket 116 (in FIG. 3), there is likewise attached the supporting mechanism 30, configured as a supporting plate 120. As shown by FIG. 3, the supporting mechanism 30 supports the printed products 20 from the left lateral edge 122 up to the first grippers 38, which act upon the printed products 20 adjacent to their right lateral edge 122'. The supporting plate 120 has a slot, running in the direction of conveyance, which is passed through by the second grippers 40 whenever they are located in the area of the active strand 44'.

The first drawing member 42 is guided in the area of the active strand 42' such that the clamping jaw 66 of the first grippers 38 is approximately aligned with the upper face of the supporting plate 120. The fixed gripper jaw 86 of the second gripper 40 has (viewed in the vertical direction) a greater distance to the supporting plate 120 than has the upper end of the first gripper 38. If, the clamping pin 90 of the second gripper 40 is in the open position, however, then this second gripper is disposed (viewed in the vertical direction) below the upper end of the first gripper 38. The path of motion of the gripper mouth 92, when the second gripper 40 is closed, runs therefore above the first grippers 38; this always when viewed in the area of the active strands 42',44'.

In the vertical direction between the opening device 24 and the conveying device 10 and laterally outside the area of the printed products 20, there is located a holding-open device 124. The holding-open device 124 has holding-open mechanisms 128 disposed on a continuous chain 126. The holding-open mechanisms 128 have telescopically extensible holding-open pins 130. The holding-open pins 130 can be introduced from the side, for example by means of a crank control system 132, between the product parts 32,36 which have been lifted apart by means of the opening device 24, in the area of the lateral edge 122'. The continuous chain 126 may be driven in the direction of revolution U at a velocity corresponding to the transport velocity v of the conveying device 10. Preferably, the continuous chain 126 is driven at a greater velocity than the transport velocity in order to hold the opened print product 20 open during onward transportation and, where appropriate, to lift the leading product part 36 still further from the trailing product part 32.

Connected downstream from the opening device 24 is a collecting device 134 having a plurality of collecting bars 136. The collecting bars 126 revolve in the direction of revolution D about a common revolutional axis (not shown in FIGS. 1 and 2). A collecting bar 136 engages in each case from below into a print product 20 which is opened by the opening device 24 and held open by the holding-open device 124. Following the opening of the corresponding transporting clamp 14 by means of an opening mechanism 138, the respective printed product 20 falls astride onto the respective saddle-shaped collecting bars 136. The collecting bars 136 can include transport means in order to displace the deposited printed products 20 in their longitudinal direction.

Figures 14, 15, 16, 17, 18, 19, 20, 21, 22, 23:
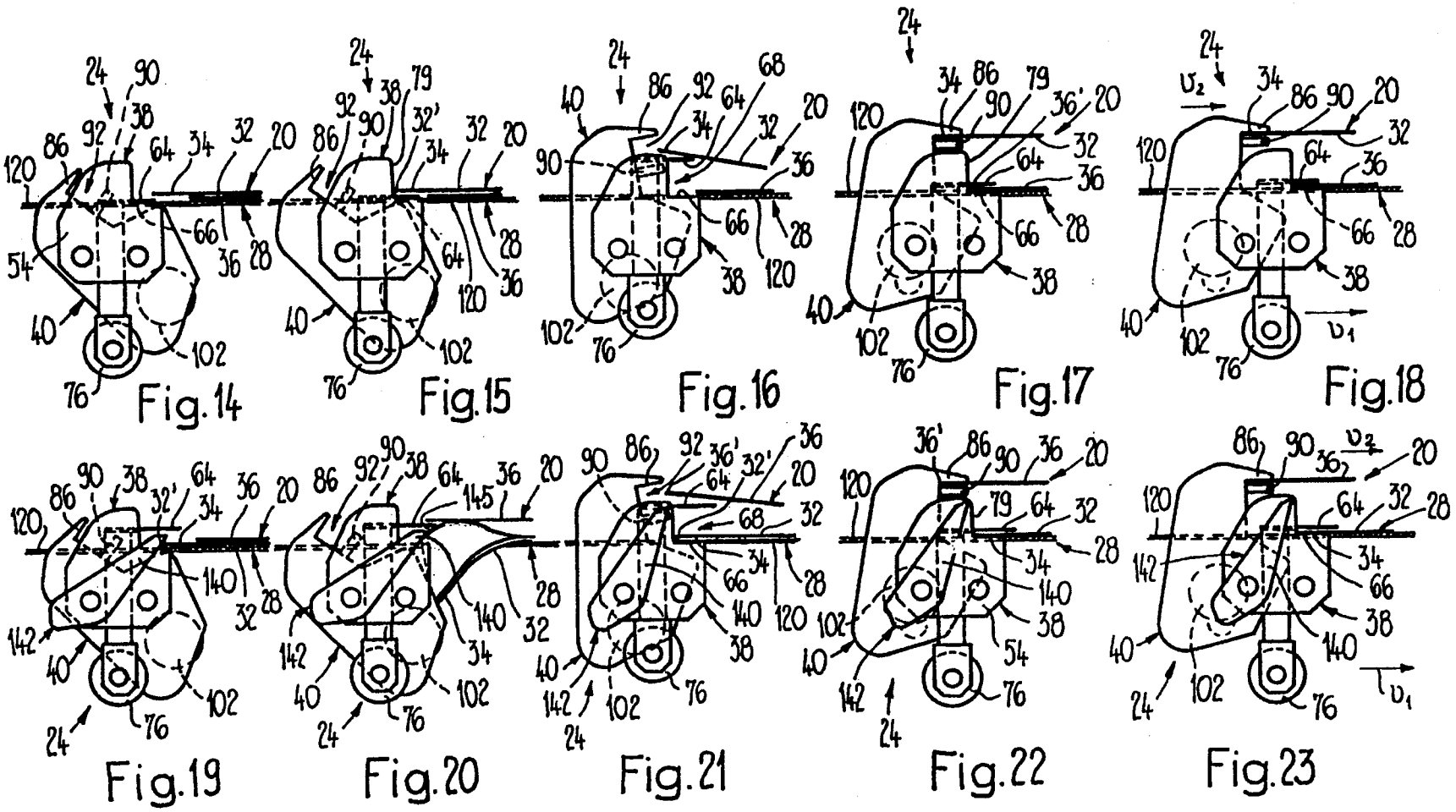
FIGS. 14 to 18 show the grippers shown in FIGS. 6–13 while grasping a printed product having an uppermost, protruding marginal section, at five different consecutive instants.
FIGS. 19 to 23 show the grippers whilst grasping a printed product having a bottommost, protruding marginal section, at five different consecutive instants.

The working method of the opening device 24 according to FIGS. 1–5 is now described with reference to FIGS. 14–18. FIGS. 14–18 show, in each case, the first gripper 38 and the second gripper 40 in the starting area of the swivel crank 110 and in the area of the opening cranks 78 and 104 at five consecutive instants. The position shown in FIG. 14 is adopted by the grippers 38,40 in the starting area of the active strands 42',44'. This can also be observed from FIG. 1 with reference to the rearmost grippers 38, 40 (viewed in the direction of conveyance F) in the area of the active strands 42'44'. The clamping tongue 64 of the first gripper 38 is in the closed position, whereas the clamping pin 90 of the second gripper 40 is already transferred into the open position. As a result of the action of the opening crank 104 upon the control roller 102 and its eccentric mounting in relation to the fastening bolt 106, the second gripper 40 adopts a backward-angled position. The first gripper 38, as a result of its velocity v1, which is greater than the transport velocity v of the conveying device 10, now gathers in the printed product 20 which is resting slidingly, with its end area 28, on the supporting plate 120. Thus, the end edge of the uppermost product part 32 comes to bear against the stop 79 of the gripper body 54, as is shown by FIG. 15. The clamping tongue 64 of the first gripper 38, as a result of the action of the opening crank 78, is now transferred into the open position. In this open position, the clamping tongue 64 grips underneath and jointly raises the marginal section 34 of the uppermost product part 32, as is shown by FIG. 16. At the same time, the second gripper 40 runs up against the swivel crank 110. The swivel crank 110 thereby pivots forwards in the clockwise direction into a position in which the axis 82' (compare FIGS. 10–13) runs approximately in the vertical direction and thus runs approximately at right-angles to the direction of conveyance F. As a result of this swivel movement, the gripper mouth 92 now gathers in the marginal section 34 in order to clamp this, upon the subsequent closing of the second gripper 40, between the gripper jaw 86 and the clamping pin 90. At approximately the same time or shortly thereafter, the clamping tongue 64 is transferred into the closed position. As a result, the underlying product part 36 is clamped in place by its end edge 32'. In this connection, it should be noted that, as a result of the relative velocity between the conveying device 10, and hence the end area 28 of the respective print product 20, and the first gripper 38, the end edge 36' of the product part 36 has come to bear against the stop 79, as is shown by FIG. 17. The first gripper 38 now increasingly moves away, in the direction of conveyance F, from the second gripper 40 (as can be observed from FIG. 18 and FIGS. 1 and 2 with reference to the grippers 38,40 in the central area of the opening device 24). As it does so, the bottommost product part 36 (viewed in the direction of conveyance F) is bulged out and lifted from the trailing, uppermost product part 32. Into the opening created thereby along the lateral edge 122' (see also FIG. 3), there is now inserted a holding-open pin 130. In the area of the deflection pulley 48, the first gripper 38 is then opened as a result of the action of the opening crank 78' and the product part 36 is released (FIG. 1). As soon as the second respective gripper 40 is also then deflected by the deflection pulley 48', its gripper mouth 92 is opened under the action of the opening crank 104' and the other product part 32 is released (FIG. 2).

Figure 24:
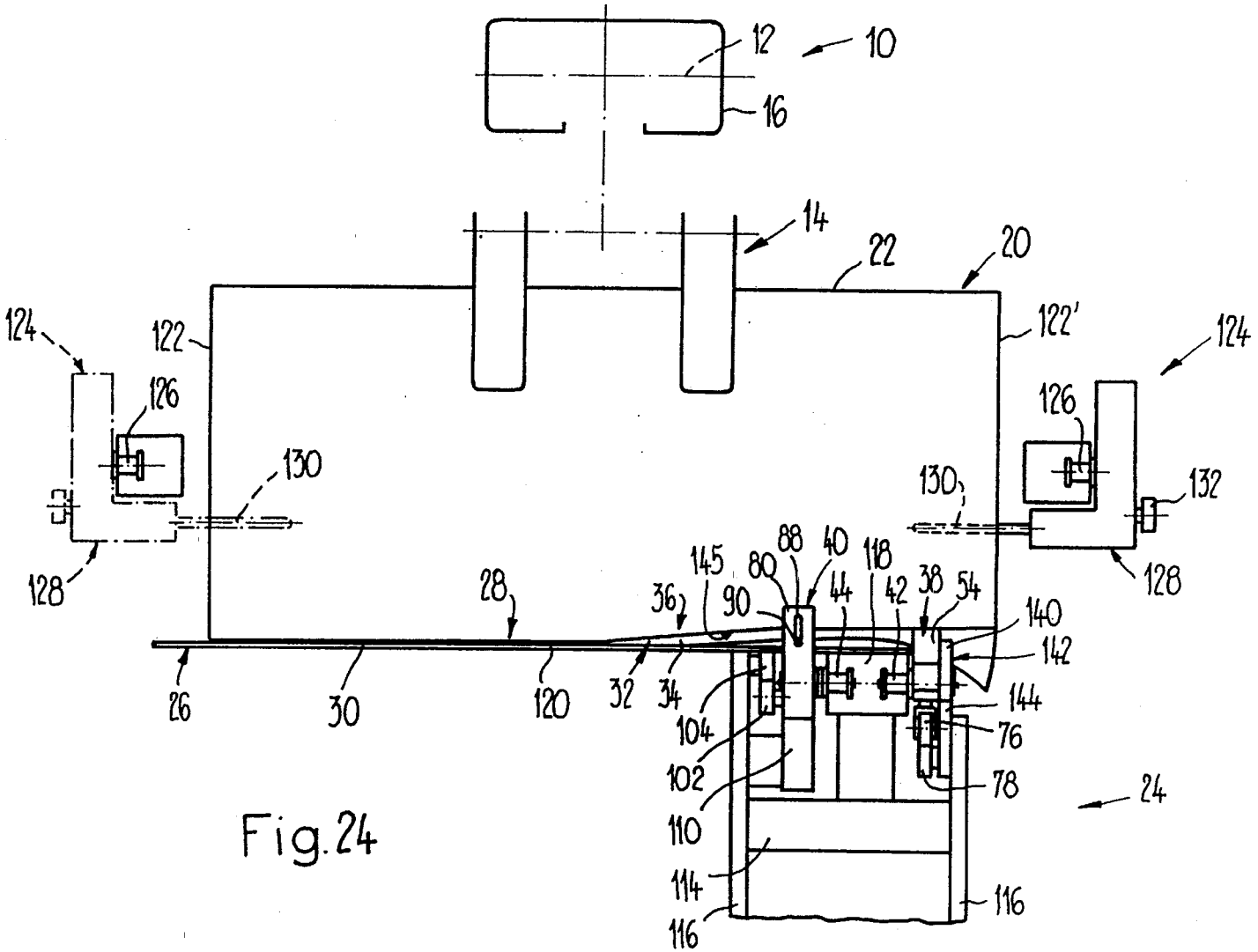
FIG. 24 shows a side view of the device according to FIG. 3 whilst opening a printed product having a bottommost, protruding marginal section.

FIGS. 19–23 show the same procedure shown in FIGS. 14–18. A printed product 20 being opened, however, is held by the transporting clamps 14 such that, the end area 28 sliding on the supporting plate 120, the longer product part 32 having the marginal section 34 is bottommost. For this purpose, the first gripper 38 comprises a bending mechanism 142, configured as a swivel cam 140, as can be observed from FIG. 3 and FIGS. 19–24. The twin-armed swivel cam 140 is pivotably mounted on the rear fastening bolt 58 of the gripper body 54 (viewed in the direction of conveyance F). The twin-armed swivel cam 140 can be pivoted by means of a swivel crank 144 (FIGS. 3 and 24) out of a rest position (FIGS. 21–23) into a working position as shown in FIGS. 19, 20 and 24. For the sake of completeness, it should be mentioned that the swivel crank 144 can be moved out of the action area onto the swivel cam 140 and that the working method of the first gripper 38 is exactly the same as has been described above with reference to FIGS. 1–18.

As is shown by FIG. 19 in comparison with FIG. 14, the swivel cam 140 which has been brought into the working position forms a stop which is ahead in relation to the stop 79 on the gripper body 54. This generates an impact force on the end edge 32' of the marginal section 34. As a result of the angularly sloping front edge of the swivel cam 140 in the working position, the marginal section 34 and an adjoining area thereto along the lateral edge 122' is bent downwards and pressed forwards in the direction of conveyance F. This results in a bulging of the bottommost product part 32 in the upward direction, as is shown by FIG. 20 and FIG. 24. This bulging extends from the first gripper 38 into the action area of the second gripper 40. This now enables the clamping tongue 64, which was previously brought into an intermediate position between the clamping and the open position, to grip underneath the uppermost shorter product part 36 by engaging into the opening 145 created as a result of the bulging of the lower product part 32 (FIGS. 20, 24). As a result of the full raising of the clamping tongue 64 into the open position, the uppermost product part 36 is raised above the first gripper 38. The second gripper 40, as a result of its swivel movement in the clockwise direction, now gathers in the end edge 36' of the product part 36 and is able to clamp this in place (FIGS. 21 and 22). The swivel cam 140 is simultaneously brought into its rest position, so that the end edge 32' of the product part 32 comes to bear against the stop 79 of the gripper body 54. Thus, the marginal section 34, when the clamping tongue 64 is transferred into the clamping position, is clamped in place by the first gripper 38. The printed product 20 is now subsequently opened in the same manner described above.

Figure 25:
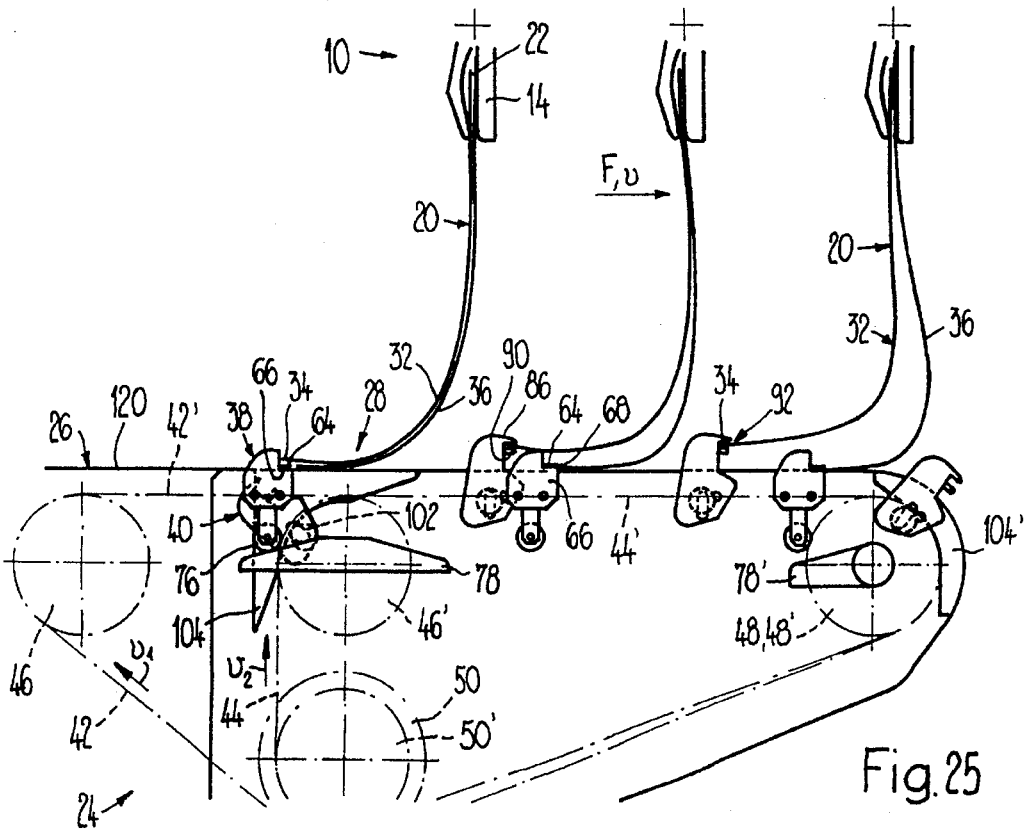
FIGS. 25 and 26 show a view of a further embodiment of the device according to the invention at two different instants separated by half a work cycle, whilst opening printed products having a trailing end section.
Figure 26:
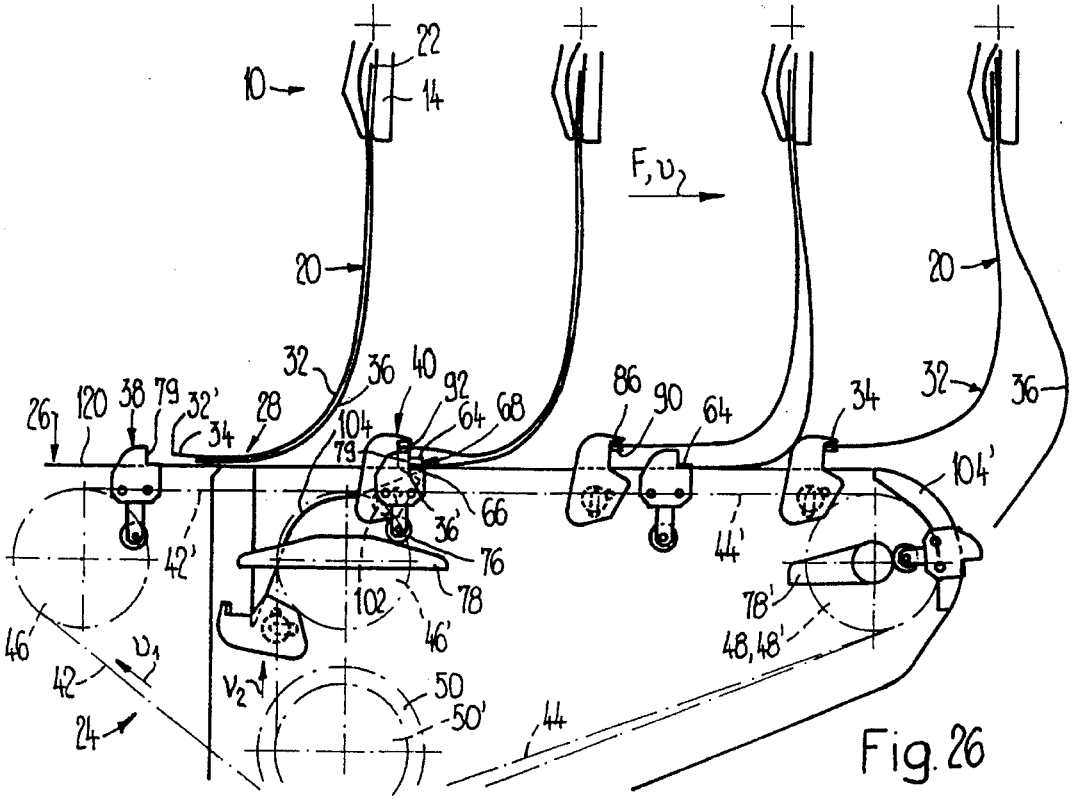

FIGS. 25 and 26 show an embodiment of the opening device 24 which is very similar to the embodiment shown in FIGS. 1–24 with the exception of two differences. The first difference consists in the fact that the deflection pulley 46 for the first drawing member 42 (viewed in the direction of conveyance F) is connected upstream from the deflection pulley 46' of the second drawing member 44. Hence, the active strands 42', 44' only continue to overlap in the area between the deflection pulley 46' and the coaxially mounted deflection pulleys 48, 48'. The second difference consists in the fact that the second grippers 40 on the second drawing member 44 are no longer pivotably disposed but are fixed. A swivel crank for the second grippers 40 is therefore no longer required and the opening crank 78 for the first grippers 38 and the opening crank 104 for the second grippers 40 are located in the area of the deflection pulley 46'. The further opening cranks 78' and 104' are located at the end of the opening device 24 (viewed in the direction of conveyance F) in order to release the product parts 32, 36 of the opened print product 20. The conveying device 10 and the gripper 38, 40 are otherwise of identical configuration to that already described above.

The working method of the embodiment shown in FIGS. 25 and 26 is as follows. The folded printed products 20 are transported, suspended, by the transporting clamps 14, having a direction of conveyance F running in the horizontal direction. Since the end area 28 of the printed products 20 rests slidingly on the supporting element 26 configured as a supporting plate 120, the printed products 20 are bent towards the rear. The longer product part 32, having the marginal section 34 protruding over the shorter product part 36, is thus uppermost (viewed in the direction of conveyance F). Since the first grippers 38 revolve at a velocity v1 which is greater than the transport velocity v of the conveying device 10, a first gripper 38 gathers, in each case, a printed product 20 in the area between the deflection pulleys 46 and 46'. Thus, the end edge 32' comes to bear against the stop 79 (FIGS. 25 and 26, first grippers 38 far left). At the deflection pulley 46', the first gripper 38 is opened by means of the opening crank 78 by the clamping tongue 64 being raised. Since the clamping tongue grips underneath the marginal section 34, the uppermost product part 32 is raised. At the same time, as a result of the deflection, a second gripper 40 swivels about the deflection pulley 46' and into the area of the active strand 44'. Since the gripper mouth 92 protrudes over the second drawing member 44 (viewed in the radially direction), the second gripper 40 gathers in the printed product 20 and embraces, by its gripper jaw 86 and by the clamping pin 90 transferred by the opening crank 104 into the open position, the marginal section 34 (see FIG. 26, grippers 38,40 in the area of the deflection pulley 46'). As a result of the relative velocity between the first gripper 38 and the conveying device 10, the end edge 36' of the bottommost product part 36 now comes to bear against the stop 79 of the first gripper 38. When the first gripper 38 sets off from the opening crank 78, the end edge 36' is clamped in place between the clamping jaw 66 and the clamping tongue 64. At approximately the same time or shortly beforehand, the second gripper 40 has also set off from the respective opening crank 104. As a result, the marginal section 34 is now secured in the gripper mouth 92. Due to the greater velocity v1 of the first gripper 38 in relation to the velocity v2 of the second gripper 40, the respective printed product 20 is now opened by the end edges 32',36' being moved away from each other in the direction of conveyance F. The leading and bottommost product part 36 is thereby bulged in the direction of conveyance F and eventually released by the first gripper 38 (as is shown by FIG. 26, far right). As soon as the second gripper 40 makes its way into the area of the opening crank 104' at the deflection pulley 48', the trailing, uppermost product part 32 is also released. The further handling of the printed products 20 can be effected in an identical manner as set out with reference to FIGS. 1–3.

The velocity v2 of the second grippers 40 corresponds approximately to the transport velocity v of the conveying device 10.

Figure 27:
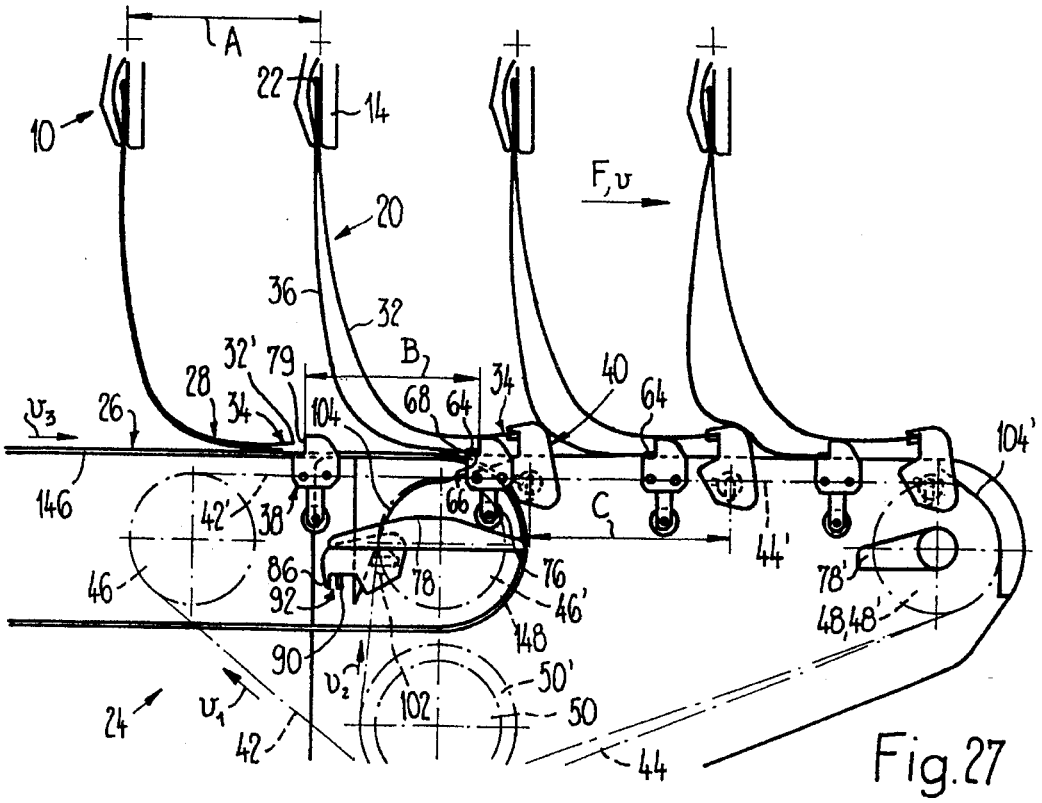
FIGS. 27 and 28 show a view of a further embodiment of the device according to the invention at two different instants separated by half a work cycle, whilst opening printed products having a leading end area.
Figure 28:
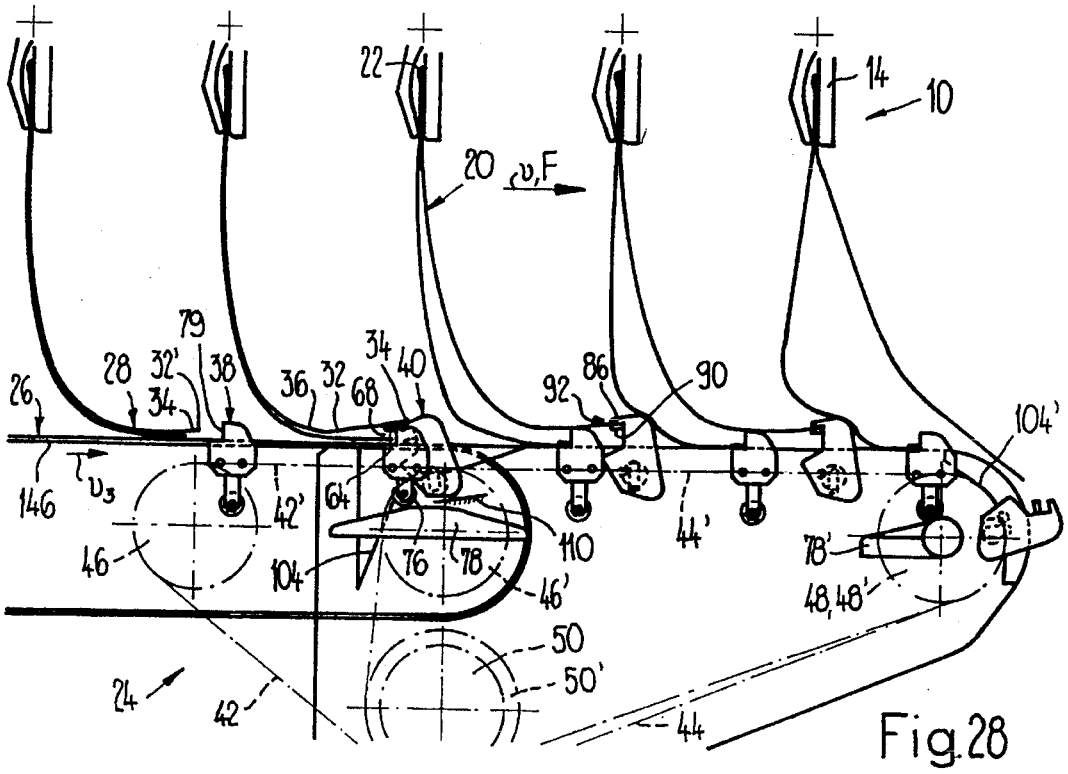

FIGS. 27 and 28 show an embodiment of the opening device 24 for opening printed products 20 having a leading end area 28 in the direction of conveyance F. In this case, the supporting element 26 is configured as a continuous supporting belt 146, which is connected upstream from the opening device 24 and is deflected, at its conveyance-effecting end, around a deflection roller 148 coaxial to the deflection pulley 46'. The supporting belt 146 is driven at a velocity v3 which is at least as great as, but is preferably greater than the transport velocity v of the conveying device 10. The printed products 20, which are transported by their fold 22 in an approximately horizontal direction of conveyance F by the transporting clamps 14, rest with their forward-bent end area 28 flatly on the supporting belt 146. The longer product part 32 having the marginal section 34, which protrudes over the shorter product part 36, is in this case uppermost. The first drawing member 42 with the first grippers 38 is deflected around the deflection pulley 46, which is connected (viewed in the direction of conveyance F) upstream from the deflection pulley 46' for the second drawing member 44 and the deflection roller 148. The distance B between the first grippers 38 is equal to or less than the distance A between the transporting clamps 14. The active strand 42' of the first drawing member 42 runs from the deflection pulley 46 to the deflection pulley 48. Thus, the active strand 42' overlaps the active strand 44' of the second drawing member 44, which active strand extends from the deflection pulley 46' up to the deflection pulley 48' coaxially to the deflection pulley 48. The distance C between the second grippers 40 is greater than the distance B between the first grippers 38. Correspondingly greater is the revolutional velocity v2 of the second drawing member 44 in relation to the revolutional velocity v1 of the first grippers 38. These different velocities v1,v2 are caused by the fact that the power-driven deflection pulley 50 for the first drawing member 42 is correspondingly smaller in diameter than the deflection pulley 50' of the second drawing member 44. For the sake of completeness, it should be mentioned that the ratio of the velocities v1 to v2 is the same as the ratio of the distances B to C.

The grippers 38, 40 are of almost identical configuration to that described above and represented in FIGS. 6–13. The sole difference is that the gripper mouth 68 of the first grippers 38 and the gripper mouth 92 of the second grippers 40 are directed counter to the direction of conveyance F. Otherwise, the construction of the opening device 24 corresponds to the embodiments already described above. For parts working in an identical manner, identical reference symbols are used and these are only shown in FIGS. 27 and 28 insofar as this is necessary for the following explanation of the working method.

In the area between the deflection pulleys 46 and 46', the leading edge 32' of a printed product 20 in each case comes to bear against the stop 79 of the first gripper 38. Since the first grippers 38 are closed in this area, the clamping tongue 64 grips underneath the protruding marginal section 34 and raises it whenever the clamping tongue 64, as a result of the opening crank 78 in the area of the deflection pulley 46', is transferred into the open position (FIG. 28, first gripper 38 next to the deflection pulley 46'). A second gripper 40, which just before the end edge 32' of the product part 32, intersects the path of movement of the radially outer end of the second gripper 40, makes its way into the area of the active strand 44'. Here it is pivoted, by means of the swivel crank 110 indicated in dash-dot representation, counterclockwise in the backward direction (viewed in the direction of conveyance F) in order to embrace, by its opened gripper mouth 92, the marginal section 34. Upon setting off from the opening crank 104, the clamping, pin 90 is raised and the marginal section 34 clamped in place between the clamping pin itself and the gripper jaw 86. As the first gripper 38 sets off from the corresponding opening crank 78, the clamping tongue 64 is transferred into the closed position. Thereupon, the clamping tongue 64 clamps in place, between itself and the clamping jaw 66, the product part 36, which has been pushed by the supporting belt 146 into the opened gripper mouth 68. As a result of the different velocities v1,v2 between the grippers 38,40, the uppermost product part 32 is now moved in the direction of conveyance F away from the bottommost product part 36. Thereupon the uppermost product part 32 is transferred into a more stretched position, as can be observed, in particular, from FIG. 28. As it does so, the product part 36 maintains its bending or is bent even more strongly if the velocity v1 of the first grippers 38 is less than the transport velocity v of the conveying device 10. By virtue of the opening crank 104' or 78', first the second gripper 40 and, later in time, the first gripper 38 are opened in the area of the deflection pulleys 48,48'. The further handling of the printed products 20 can be effected in an identical manner to that shown in FIGS. 1–3.

If the first grippers 38 are equipped with a bending mechanism 142, then printed products 20 can also be handled using the opening device 24 as shown in FIGS. 27 and 28. With this configuration, printed products are fed to the opening device 24 with the end area 28 ahead and the marginal section 34 bottommost. The two product parts 32, 36 are lifted apart in an analogous manner to that shown in FIGS. 19–23 and described above.

The clamping tongue 64 and the bending mechanism 142 form separating means which lift the two product parts 32, 36 apart, transversely to the direction of conveyance F. This enables the two product parts 32, 36 to be securely grasped, in each case, by the corresponding grippers 38, 40.

Figure 29:
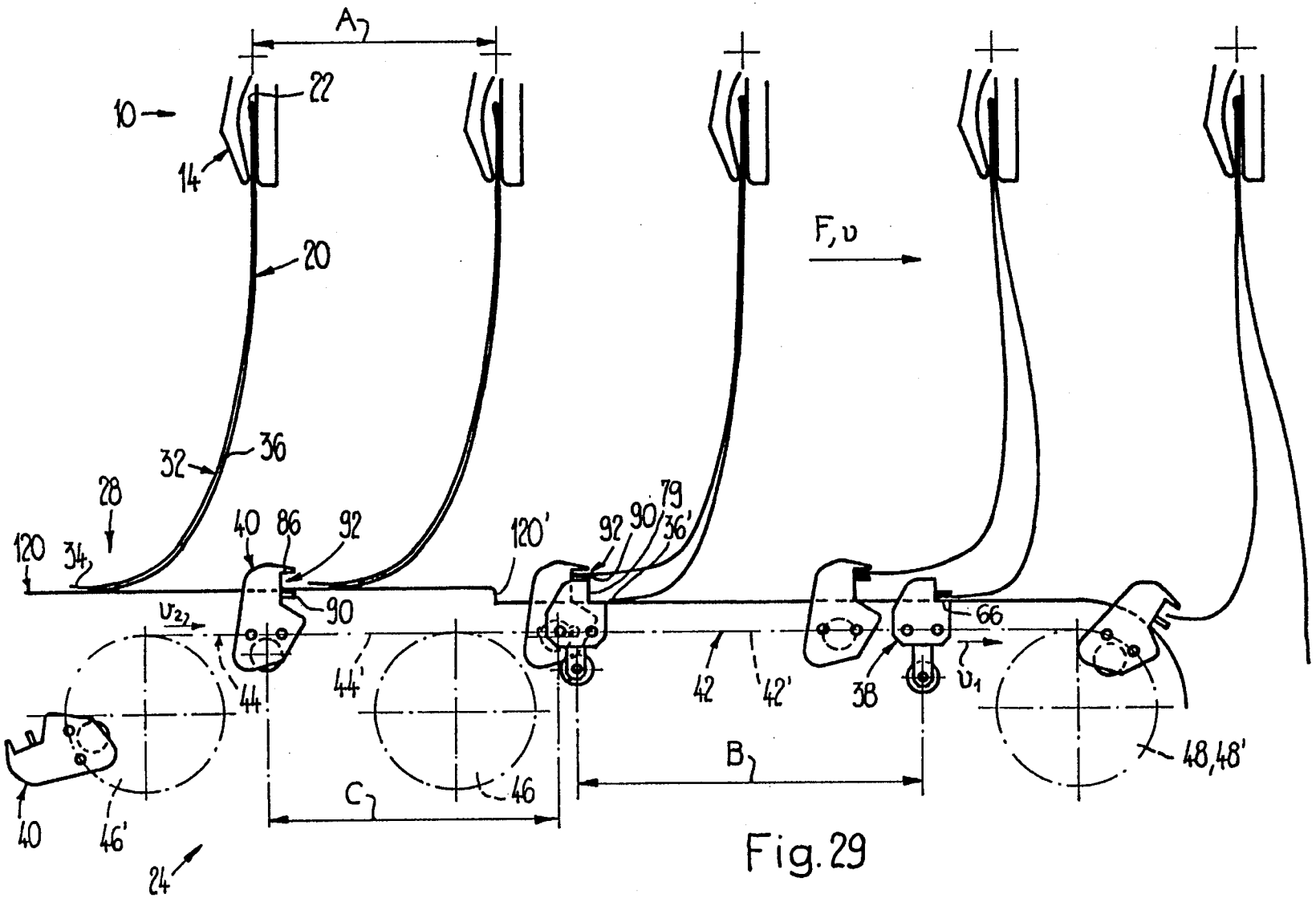
FIG. 29 shows a view, in much simplified representation, of a further embodiment of the device according to the invention, whilst opening printed products having a trailing end area.

In the case of the embodiment according to FIG. 29, the deflection pulley 46' for the second drawing member 44 with the second grippers 40 (viewed in the direction of conveyance F) is connected upstream of the deflection pulley 46 for the first drawing member 42 with the first grippers 38. The active strands 42' and 44' overlap in the area between the deflection pulley 46 and the coaxially mounted deflection pulleys 48, 48' at the end of the opening device 24. The drive of the drawing members 42, 44 is effected, in the same manner as already described above, via deflection pulleys 50, 50' (compare FIGS. 25, 26), which in FIG. 29 are no longer shown. The velocity v1 of the first grippers 38 and the distance B between these grippers 38 are correspondingly greater than the velocity v2 of the second grippers 40 or the distance C between these grippers 40. Furthermore, the velocity v2 is at least as great as the transport velocity v of the transporting clamps 14 of the conveying device 10. Preferably however, the velocity v2 is greater than the transport velocity v of the transporting clamps 14 of the conveying device 10. Obviously, the distances A and C are matched accordingly.

The supporting plate 120 has a step 120', descending in the direction of conveyance F, at the deflection pulley. Up to this step 120', the actively supporting surface of the supporting plate 120 is located above the clamping pins 90 of the opened second grippers 40, but obviously beneath the gripper jaw 86. In the direction of conveyance F, following the step 120', the actively supporting surface of the supporting plate 120 is aligned with the clamping jaw 66 of the first gripper 38. Also, in this embodiment, the path of movement of the gripper mouth 92 runs above the first gripper 38.

The construction of the grippers 38, 40 is almost identical to that already described above and represented in FIGS. 6 to 13, except that the second grippers 40, like the first grippers 38, are disposed in a fixed manner, i.e. non-pivotably, on the drawing members 42,44. For the sake of improved clarity, the opening cranks 78, 78', 104, 104' described above are not represented in FIG. 29. Their location can be derived from the following description of the working of the device according to FIG. 19.

The printed products 20 are held by their fold 22 in approximately vertical suspension by the transporting clamps 14. These printed products 20 are transported, resting with their end area 28 on the supporting plate 120, at the transport velocity v. The longer product part 32 having the marginal section 34 is in this case, trailing and uppermost in relation to the shorter product part 36.

In each case, between two printed products 20, an already opened second gripper 40 swivels, at the deflection pulley 46', into the active strand 44'. Here the gripper 40 gathers in the leading printed product 20, up to the step 120', so that the marginal section 34 makes its way into the open gripper mouth 92. The clamping pin 90 grips underneath the marginal section 34 and raises it as the second gripper 40 is closed. The longer product part 32 is thereupon lifted, area by area, from the bottommost shorter product part 36. Upon traveling over the step 120', the end edge 36' and the adjoining area thereto of the product part 36, in being lifted from the uppermost, held product part 32, drops downwards onto the supporting plate 120. An opened first gripper 38, which has been swiveled around the deflection pulley 46 into the area of the active strand 42', now gathers in the product part 32. In this manner, the end edge 32' of the product part 32 comes to bear against the stop 79. Upon the subsequent lowering of the clamping tongue 64 towards the clamping jaw 66 into the closed position, the bottommost product part 36 is clamped in place and moved away from the other product part 32 in the direction of conveyance F. In the area of the deflection pulleys 48, 48', the grippers 38, 40 are then successively opened, so that they release the lifted apart product parts 32, 36.

Figure 30:
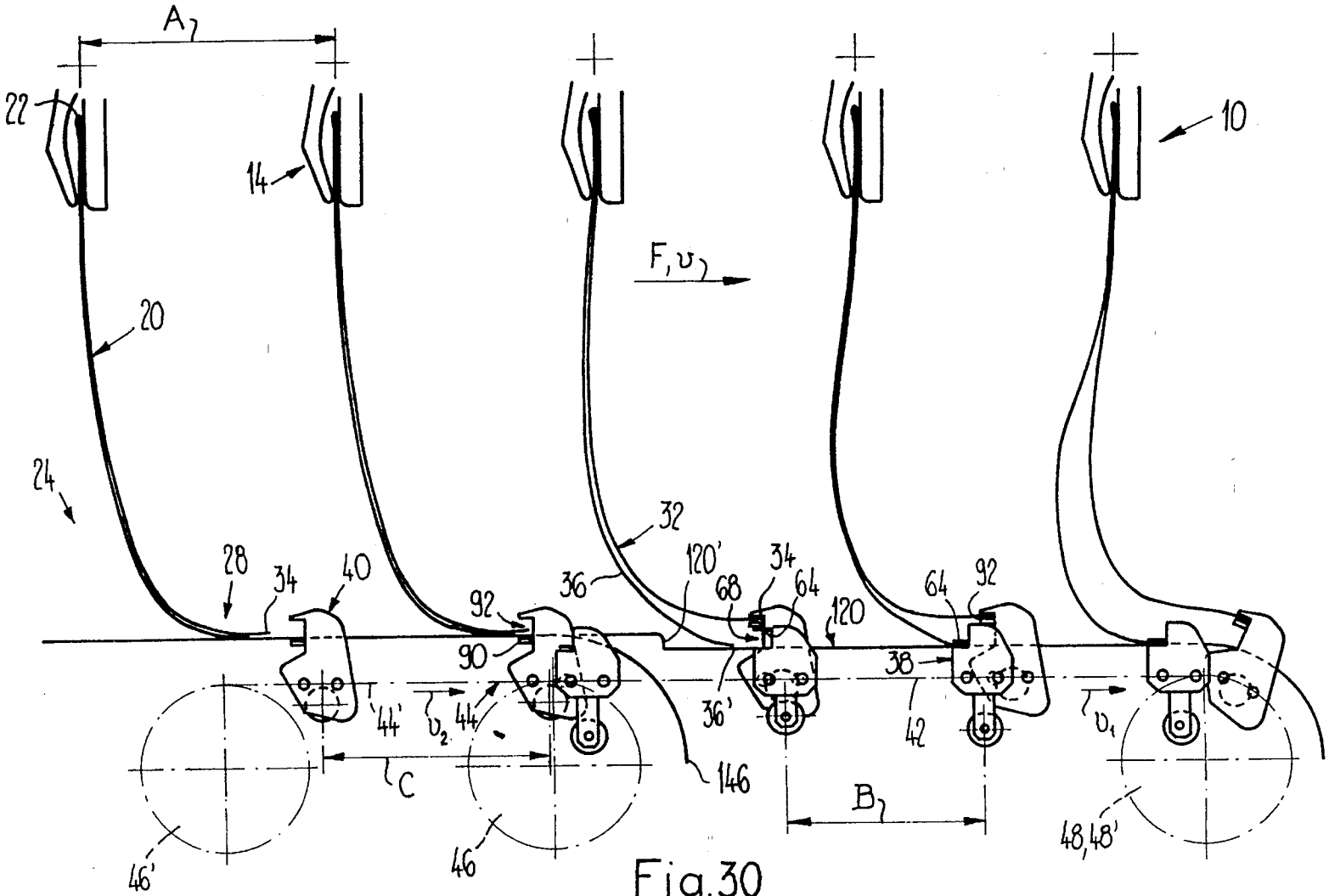
FIG. 30 shows a view, in much simplified representation, of an embodiment very similar to the embodiment according to FIG. 29 of the device according to the invention, whilst opening printed products have a leading end area.

The opening device 24 shown in FIG. 30 is extremely similar in its construction to the opening device according to FIG. 29. Hereafter, reference shall only be made to the differences where this is necessary for understanding. The deflection pulleys 46, 46', 48, 48', 50, 50' are disposed identically and the drawing members 42,44 are guided in an identical manner to that shown in FIG. 29, except that the gripper mouths 68, 92 are directed rearwards counter to the direction of conveyance F. The velocity v1 of the second grippers 40 is approximately as great as, but preferably less than the transport velocity v. The velocity v1 of the first grippers 38 is less than the velocity v2. Accordingly, the distance A between the transporting clamps 14 is as great as or greater than the distance C between the second grippers 40, and the distance B between the first grippers 38 less than the distance C.

The supporting belt 146 is driven in the direction of conveyance F at a speed which is at least as great as, but preferably greater than the transport velocity v. This permits the printed products 20 to be fed, resting with their end area 28 on the supporting belt and with the marginal section 34 ahead, to the second grippers 40. The supporting belt 146, runs in a gap in the supporting plate 120 and protrudes over the supporting plate 120 with its actively conveying upper strand. This supporting belt 146 is guided around a roller (not shown in FIG. 30) which is mounted coaxially to the deflection pulley 46, so that it is actively conveying and actively supporting, commencing upstream of the deflection pulley 46', up to the deflection pulley 46.

The drawing members 42, 44 are synchronized such that, in an area commencing at the deflection pulley 46 and continuing to beyond the descending step 120' in the supporting plate 120, the first gripper 38 leads the corresponding second gripper 40 and then, prior to the deflection pulleys 48, 48' being reached, the second gripper 40 overtakes the first gripper 38.

The device according to FIG. 30 works as follows. The printed products 20 are conveyed, suspended by the fold 20 in an approximately vertical direction, by the transporting clamps 14. The longer product part 32 is ahead in relation to the shorter product part 36. As a result of the supporting belt 146, the end area 28 is ahead and the marginal section 34 is uppermost. At the deflection pulley 46', a second gripper 40 in each case, opened by means of the opening crank (not shown), swivels in between, in each case, two printed products 20. Since the end area 28 is moved at greater velocity than the second gripper 40, the marginal section 34 runs into the opened gripper mouth 92. Thus, when the gripper 40 is closed at the deflection pulley 46, the marginal section 34 gripped underneath by the clamping pin 90 is raised and clamped in place in the gripper mouth 92. After traveling over the step 120', the bottommost shorter product part 36 fills, with its section adjoining the leading end edge 36', further away from the uppermost product part 32 and makes its way into the mouth 68 of the first gripper 38 approximately as this is being overtaken by the corresponding second gripper 40. As a result of the lowering of the clamping tongue 64, the product part 32 is clamped in place and the product parts 32, 36, as a result of the relative velocity between the grippers 38, 40, are then lifted further apart in the direction of conveyance F. Obviously, the path of movement of the closed gripper mouth 92 runs above the first gripper 38. At the deflection pulleys 48, 48', the grippers 38, 40 are then opened for the release of the product parts 32, 36 which have been lifted apart.

In the case of the embodiments of the opening device 24 shown in FIGS. 29 and 30, the clamping pin 90 and the step 120' in the supporting plate 120 form the separating means in order to lift apart, transversely to the direction of conveyance, the product parts 32, 36 bearing against each other.

Obviously, the grippers can be of a different embodiment. It is also conceivable, for example, for the grippers to be driven not revolutionally but moving back and forth.

The drawing members 42, 44 can also be driven individually. This enables simple synchronization and adaptation to different formats of the printed products to be opened.

Depending upon the arrangement of the opening device 24 in relation to the conveying device 10, the printed products can be opened on the left, in the center or on the right. It is also conceivable to dispose two identical opening devices 24 side by side, so that the printed products are simultaneously opened in two areas.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. A device for opening folded, printed products such as newspapers and magazines and portions thereof, wherein each product is folded so as to have a fold between one product part and another product part, each of said product parts having an end edge opposite the fold and the end edges of both of those product parts forming an end area of the product facing away from the old, the device comprising:

a conveying device having a plurality of transporting clamps for holding individual printed products by the fold and carrying them in a conveying direction; and an opening device disposed beneath the conveying device;

said opening device including a supporting element extending approximately parallel to said conveying direction for supporting the product in its end area;

said opening device further including at least one first gripper for grasping and holding one product part by its end edge and at least one second gripper for grasping and holding the other product part by its end edge;

said opening device further including a gripper drive mechanism for driving the first and second grippers at different velocities so as to move the held end edges away from each other.

* * * * *